US010875089B2

(12) United States Patent
Nishida et al.

(10) Patent No.: US 10,875,089 B2
(45) Date of Patent: Dec. 29, 2020

(54) SYSTEM FOR PRODUCING STEEL CASTINGS

(71) Applicants: SINTOKOGIO, LTD., Aichi (JP); FUJIWA DENKI CO., LTD., Aichi (JP)

(72) Inventors: Tadashi Nishida, Aichi (JP); Hiroyuki Tamotsu, Aichi (JP); Toshiyuki Hyodo, Aichi (JP)

(73) Assignees: SINTOKOGIO, LTD., Aichi (JP); FUJIWA DENKI CO., LTD., Aichi (JP)

( * ) Notice: Subject to any disclaimer, the term of this patent is extended or adjusted under 35 U.S.C. 154(b) by 0 days.

(21) Appl. No.: 16/452,656

(22) Filed: Jun. 26, 2019

(65) Prior Publication Data

US 2020/0009647 A1 Jan. 9, 2020

(30) Foreign Application Priority Data

Jul. 6, 2018 (JP) ..... 2018-128752

(51) Int. Cl.

| | |
|---|---|
| ***B22D 41/12*** | (2006.01) |
| ***B22D 41/06*** | (2006.01) |
| ***B22D 41/01*** | (2006.01) |

(52) U.S. Cl.

CPC ..... *B22D 41/12* (2013.01); *B22D 41/01* (2013.01); *B22D 41/06* (2013.01)

(58) Field of Classification Search

CPC ..... B22D 41/01; B22D 41/06; B22D 41/12

See application file for complete search history.

(56) References Cited

FOREIGN PATENT DOCUMENTS

| | | |
|---|---|---|
| JP | 8-290254 A | 11/1996 |
| JP | 5492129 B2 | 5/2014 |
| JP | 5934451 B1 | 5/2016 |

*Primary Examiner* — Kevin P Kerns
*Assistant Examiner* — Steven S Ha
(74) *Attorney, Agent, or Firm* — Finnegan, Henderson, Farabow, Garrett & Dunner, LLP

(57) ABSTRACT

To provide a system for producing steel castings that is simple and suitable to continuously produce many small steel castings. A system 1 comprises multiple furnaces 10 that are aligned and hold molten metal for cast steel, a pouring machine 20 that has a ladle 30 that receives the molten metal from the furnaces, wherein the pouring machine travels in parallel to a line of the furnaces and pours the molten metal into a mold 70 by tilting the ladle, a line 60 for conveying the molds that intermittently conveys molds that are aligned in parallel to a direction in which the pouring machine travels, wherein the line is located on the opposite side of the furnaces across the pouring machine, and a temperature sensor 38 that measures a temperature of the molten metal so as to generate an alarm if the temperature is low.

13 Claims, 8 Drawing Sheets

SYSTEM FOR PRODUCING STEEL CASTINGS

TECHNICAL FIELD

The present invention relates to a system for producing steel castings that casts steel castings.

BACKGROUND ART

An apparatus for producing a cast product has been known. By it, a ladle for reaction receives molten metal from a furnace. The molten metal is reacted with alloyed materials in the ladle for reaction. The molten metal that has reacted with the alloyed materials is transferred to a ladle for pouring. The molten metal is poured from the ladle for pouring into a mold on a line for molds by means of a pouring machine (for example, Patent Literature 1).

Further, a steel casting has been known. It is produced by pouring molten metal into a mold like a general casting, but a cast product contains less carbon and is excellent in strength. The steel casting has a carbon content of 2% or less. Thus, it can be distinguished from a general casting (also called "cast iron"). The cast steel has a more uniform structure, a higher strength, and a more uniform quality, compared with cast iron. These are excellent advantages for cast steel.

However, the melting temperature and pouring temperature of the steel casting are high. Further, if the temperature decreases, the reduction in fluidity is disadvantageously large. Thus, it would take a long time to melt in the melting furnace. The molten metal at a high temperature must be continuously poured into a mold in a short time, i.e., without any stop. Thus, conventionally it has been mainly used for a large product with a simple shape, such as a screw.

Recently, requirements have been increasing to use steel castings for small products with complicated shapes. A method for pouring molten metal from a tundish into a breathable mold that has a vacant part so as to be able to be decompressed was proposed (Patent Literature 2). However, it is not suitable for continuously manufacturing many small products, since the outlet of the molten metal at the bottom of the tundish is made of sand that is solidified by means of gas, and is consumable.

To overcome the above disadvantages, an invention to use a furnace that is equipped with a heat source instead of a ladle was proposed (for example, see Patent Literature 3). By pouring molten metal from the furnace, the pouring temperature becomes high, but the structure is complicated and the cost increases.

PRIOR-ART PUBLICATION

Patent Literature

[Patent Literature 1]

Japanese Patent No. 5934451

[Patent Literature 2]

Japanese Patent Laid-open Publication No. H8-290254

[Patent Literature 3]

Japanese Patent No. 5492129

SUMMARY OF INVENTION

Problem to be Solved by Invention

The purpose of the present invention is providing a system for producing steel castings that has a simple structure and is suitable to continuously produce many small steel castings.

Means to Solve the Problem

To solve the problem, as in FIGS. 1 and 2, for example, a system 1 for producing steel castings of a first aspect of the present invention comprises multiple furnaces 10 that are aligned and hold molten metal for cast steel. It also comprises a pouring machine 20 that has a ladle 30 that receives the molten metal from the furnaces 10, wherein the pouring machine 20 travels in parallel to a line of the multiple furnaces 10 and pours the molten metal into a mold 70 by tilting the ladle 30. It also comprises a line 60 for conveying the molds that intermittently conveys multiple molds 70 that are aligned in parallel to a direction in which the pouring machine 20 travels, wherein the line 60 for conveying the molds is located on the opposite side of the furnaces 10 and across the pouring machine 20. It further has a temperature sensor 38 that measures a temperature of the molten metal in the ladle 30 so as to generate an alarm if the measured temperature is below a predetermined temperature.

By this configuration, since the pouring machine travels in parallel to the multiple furnaces that are aligned to receive molten metal from them, the molten metal can be properly poured into the molds even when the molten metal for cast steel takes a long time to melt. Since the molten metal is received by the ladle of the pouring machine and is poured into the molds on the line for conveying the molds that is parallel to the line of the furnaces and running across the pouring machine, the molten metal is poured into the mold immediately after being received by the ladle. Namely, since the molten metal for cast steel can be poured into a mold with little loss of temperature, no effect is caused by the possible reduction in fluidity. Further, since the temperature of the molten metal in the ladle is measured to generate an alarm if it is less than the predetermined one, producing a defective steel casting by pouring molten metal that is at a low temperature and has reduced fluidity can be prevented.

By the system 1 for producing steel castings of a second aspect of the present invention, when the alarm is generated, the pouring of the molten metal is stopped and the molten metal is returned to the furnaces. By this configuration no molten metal that is at a low temperature is poured into a mold and so no molten metal is wasted.

By the system 1 for producing steel castings of a third aspect of the present invention, as in FIG. 5, for example, the pouring machine 20 has a device 40 for moving the ladle that moves the ladle 30 between a side of the furnaces 10 and a side of the molds 70. By this configuration, since the pouring machine causes the ladle to receive the molten metal from the furnace, causes the ladle to move by means of the device for moving the ladle, and causes the ladle to pour the molten metal into a mold, the molten metal is poured into the mold immediately after the molten metal is received by the ladle.

By the system 1 for producing steel castings of a fourth aspect of the present invention, as in FIGS. 5 and 6, for example, the device for moving the ladle is a roller conveyor 40 that moves the ladle 30 from a position for receiving the molten metal from the furnaces 10 to a position for pouring molten metal into the molds 70. By this configuration, since the ladle can be moved from the position for receiving the molten metal to the position for pouring molten metal by means of the roller conveyor, the ladle can be quickly moved by a simple structure.

By the system 1 for producing steel castings of a fifth aspect of the present invention, as in FIG. 7, for example, the pouring machine 20 has a travelling bogie 22 that transports the pouring machine 20, a device 46 for vertically moving the roller conveyor 40, a device 48 for moving the roller conveyor back and forth that moves the roller conveyor 40 toward the position for receiving the molten metal and the position for pouring molten metal, and a device 42 for tilting the roller conveyor that tilts the roller conveyor 40 to cause the ladle 30 to pour the molten metal into a mold. By this configuration, the ladle can receive the molten metal from the multiple furnaces. The ladle can be moved to the front of the mold into which the molten metal is poured. By controlling the operations of the device for vertically moving the roller conveyor, the device for moving the roller conveyor back and forth, and the device for tilting the roller conveyor, three positions, i.e., the vertical position, the back and forth position, and the angle that the ladle tilts, can be simultaneously controlled through the roller conveyor to keep a suitable position for pouring the molten metal into the mold.

By the system 1 for producing steel castings of a sixth aspect of the present invention, as in FIG. 5, for example, the pouring machine 20 has a device 50 for putting on a cover that puts a cover 52 on the ladle 30 and removes the cover 52 from the ladle 30. By this configuration since the cover has been removed from the ladle when it receives the molten metal, and is put on the ladle after it has received the molten metal, the temperature of the molten metal is prevented from decreasing, because no air circulates in the ladle.

By the system 2 for producing steel castings of a seventh aspect of the present invention, as in FIG. 4, for example, the mold 70 is a tight flask mold and a through-hole 74 is formed in a flask 72. The system further comprises a device 80 for decompression that has multiple connecting ports 82 along the line 60 for conveying the molds, wherein the ports 82 are connected to the through-hole 74 of the flask 72 of the mold 70, into which the molten metal is poured, so as to decompress the mold 70. By this configuration, since the molten metal can be poured into a mold on the line for conveying the molds, which mold is decompressed, the molten metal can be quickly poured into a mold.

The system 1 for producing steel castings of an eighth aspect of the present invention, as in FIG. 8, for example, further comprises a device 90 for supplying antioxidant gas that fills the ladle 30 with antioxidant gas. By this configuration, since antioxidant gas is caused to fill the ladle, the molten metal for cast steel that is at a high temperature can be prevented from oxidizing.

By the system 1 for producing steel castings of a ninth aspect of the present invention, as in FIG. 8, for example, the ladle 30 has a porous refractory layer 34 between a metal shell 34 and a refractory material 36. By this configuration, since the antioxidant gas fills the ladle through the porous refractory layer, the molten metal for cast steel that is at a high temperature can be prevented from oxidizing.

By the present invention, since the molten metal can be properly supplied to the ladle and can be poured into a mold immediately after it is received by the ladle, the molten metal can be prevented from having its temperature drop. Further, since pouring molten metal that has less fluidity caused by any possible temperature drop is prevented from being poured into a mold, a system for producing steel castings that is simple and suitable for producing many small steel castings can be provided.

The basic Japanese patent application, No. 2018-128752, filed Jul. 6, 2018, is hereby incorporated by reference in its entirety in the present application.

The present invention will become more fully understood from the detailed description given below. However, that description and the specific embodiments are only illustrations of the desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, under the doctrine of equivalents, a part of the present invention.

The use of the articles "a," "an," and "the" and similar referents in the specification and claims are to be construed to cover both the singular and the plural form of a noun, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

DISCLOSURE OF INVENTION

Figure 1:
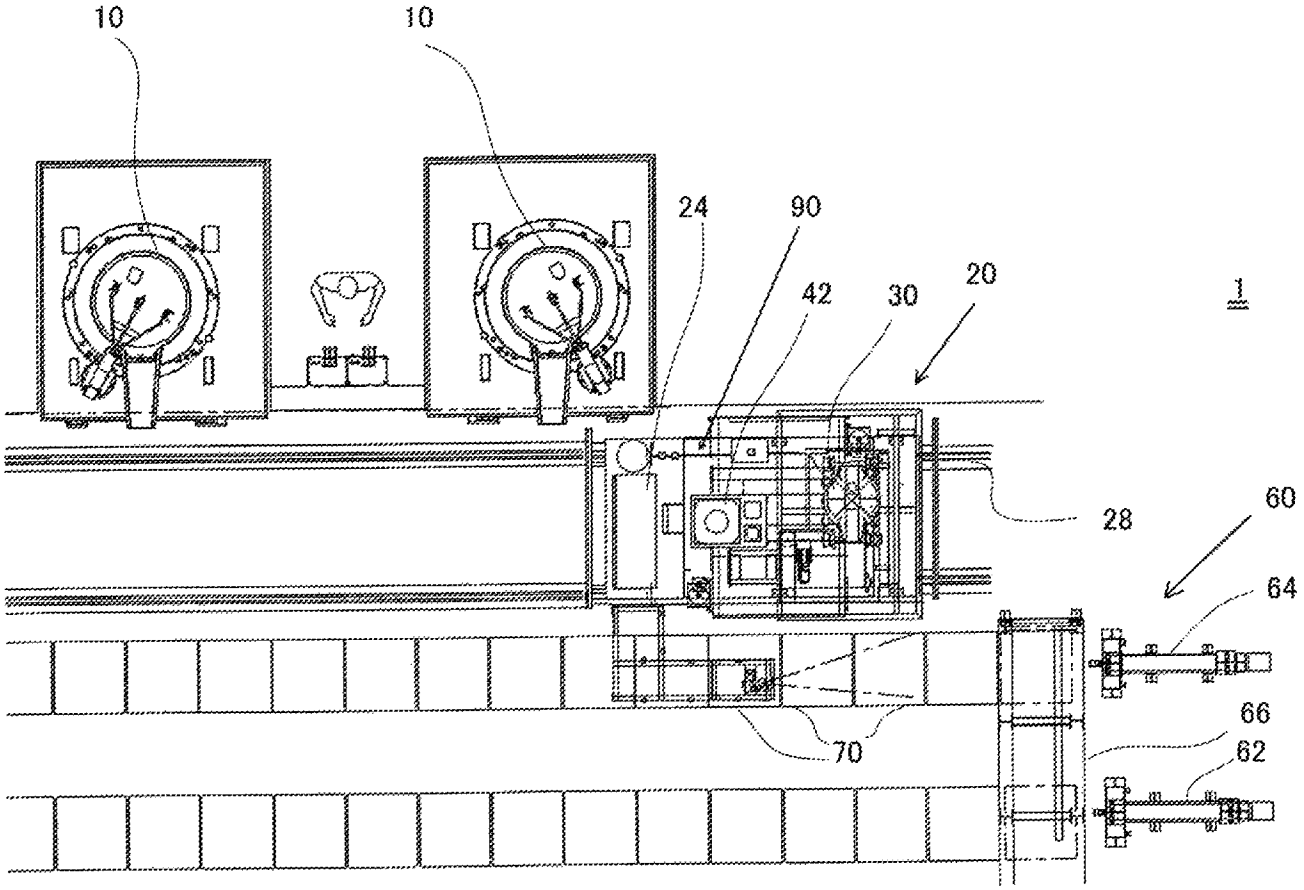
FIG. 1 is a plan view of the system for producing steel castings of an embodiment of the present invention.
Figure 2:
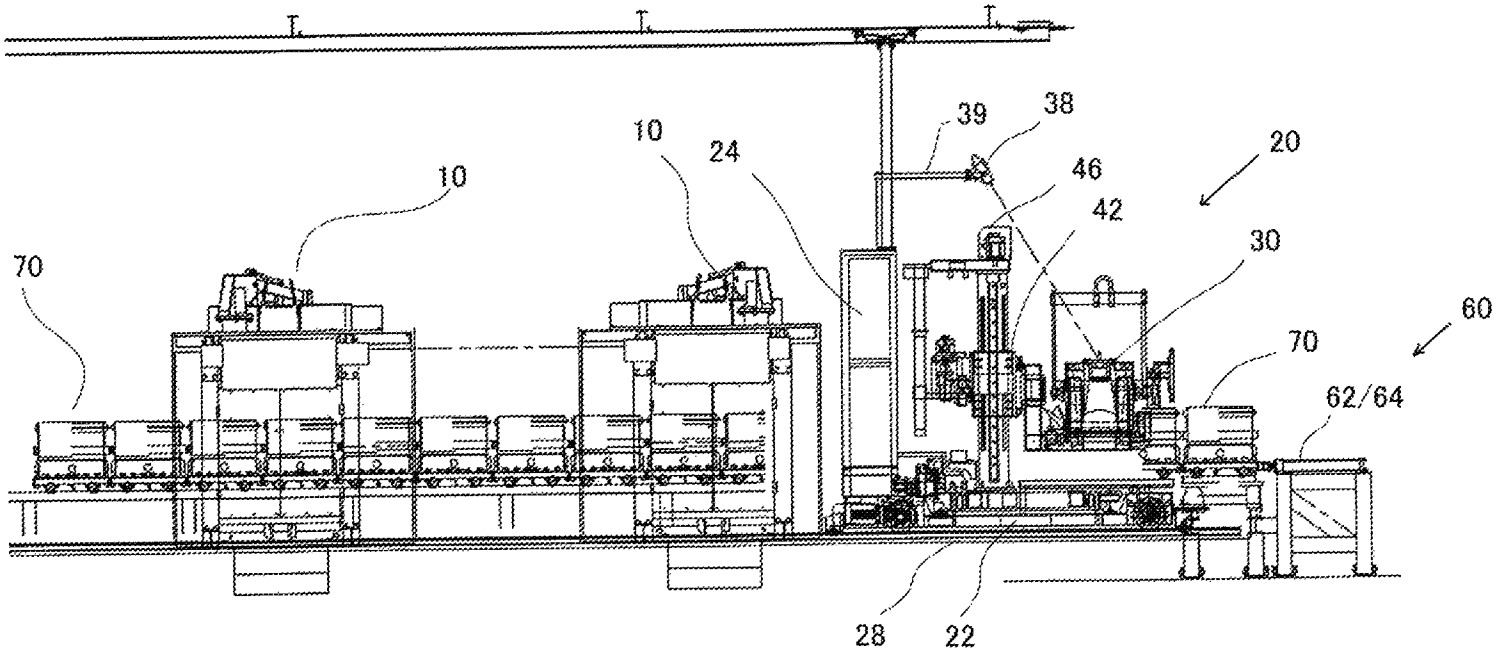
FIG. 2 is a front view of the system for producing steel castings shown in FIG. 1. Apart of the line for conveying the molds is omitted.

Below, with reference to the drawings, embodiments of the present invention are discussed. In the drawings, the same numeral or symbol is used for the elements that correspond to, or are similar to, each other. Thus duplicate descriptions are omitted. In the drawings, some parts are omitted to clearly illustrate the element to be discussed. First, with reference to FIGS. 1 and 2, the configuration of a system 1 for producing steel castings is discussed. FIG. 1 is a plan view of the system 1 for producing steel castings that illustrates furnaces 10, a pouring machine 20, and a line 60 for conveying molds near the pouring machine 20. FIG. 2 is a front view of the system 1 for producing the steel castings of FIG. 1. In it, some parts of the system 1 for producing steel castings are omitted to clearly show the furnaces 10 and the pouring machine 20.

The system 1 for producing steel castings has multiple melting furnaces 10 that melt and hold molten metal for cast steel. FIG. 1 illustrates two melting furnaces 10, but three or more furnaces 10 may be installed. Since cast steel solidifies at 1,540° C., the molten metal for cast steel is heated to 1,600° C. or above to be melted and held in the melting furnaces 10. If the melting furnaces 10 were big, the time to melt the molten metal would increase. Thus small melting furnaces 10 are used. Since it takes a long time to heat the molten metal to a high temperature, the system 1 for producing steel castings has multiple melting furnaces 10. The melting furnaces 10 are aligned. By tilting the melting furnace 10 the molten metal for cast steel is poured from the melting furnace 10 to a ladle 30 of the pouring machine 20.

The system 1 for producing steel castings has the pouring machine 20 that has the ladle 30. The pouring machine 20 has a travelling bogie 22 to travel on a rail 28. The rail 28 is laid in parallel to the melting furnaces 10 that are aligned. By moving the travelling bogie 22 on the rail 28, the ladle can receive the molten metal for cast steel from an appropriate melting furnace 10 among the multiple melting furnaces 10. Namely, a melting furnace 10 in which the molten metal for cast steel is heated to a high temperature and melted, is selected so as to receive the molten metal from that furnace. As discussed later, in the pouring machine 20 the ladle 30 is tilted by means of a device 42 for tilting the roller conveyor to pour the molten metal into a mold 70.

The system 1 for producing steel castings has a line 60 for conveying the molds that intermittently conveys the molds 70. Generally, the line 60 for conveying the molds is disposed in parallel to the direction in which the pouring machine 20 travels, namely, in parallel to the aligned melting furnaces 10. Here, the word "generally" is added because, as in FIG. 1, the line 60 for conveying the molds has multiple parallel lines on which multiple molds 70 line up and has traversers 66 to move the molds 70 between the multiple parallel lines. The line 60 for conveying the molds has the pushers 62 and the cushions 64 at the respective ends of the lines on which the molds 70 line up. The pusher 62 pushes the mold out by a distance that equals the length of a mold 70. The cushion 64 holds the mold 70 that is pushed out to stably convey the molds 70. Incidentally, FIGS. 1 and 2 illustrate only the part of the line 60 for conveying the molds that is near the melting furnaces 10 and the pouring machine 20. The cushion 64 and the pusher 62 are provided in the opposite ends of the pusher 62 and the cushion 64, which are illustrated. A traverser 66 is provided to move the mold 70 at the end of a line to the end of the next line. A shake-out machine (not shown) is also provided. In the drawings, the molds are shown in two lines. However, they may line up in three or more lines. The molds 70 may be tight flask molds or flaskless molds.

The system 1 for producing steel castings has a temperature sensor 38 that measures the temperature of the molten metal for cast steel in the ladle 30. The temperature sensor 38 is typically a noncontact temperature sensor that uses radiation such as infrared rays to measure the temperature at the surface of the molten metal (at the part to pour the molten metal, which part is not covered, if the cover 52 is put on as discussed below). The temperature sensor 38 may be a fiber-type two-color pyrometer. The temperature sensor 38 is supported by an arm 39 for the temperature sensor so as to move the position to measure the temperature in response to the movement of the ladle 30. The data on the measured temperature is transmitted via a cable for the temperature to a controller (not shown) that controls the operations of the system 1, 2 for producing steel castings. The controller is not necessarily a controller for the system 1, 2 for producing steel castings but may be a controller for another system (for example, a control board 24 for the pouring machine 20). It may be located apart from the system 1, 2 for producing steel castings. Alternatively, the data on the measured temperature may be transmitted to the controller through the control board 24 of the pouring machine 20, etc. It may be transmitted not via the cable for the temperature, but via another cable or via a radio.

By the system 1 for producing steel castings that is configured as above, since the molds 70 line up on the line 60 for conveying the molds in parallel to the direction where the pouring machine 20 travels, the molten metal can be sequentially poured from the pouring machine 20 into the molds 70. If conveying the molds 70 takes longer than pouring the molten metal into one of the molds 70, the molten metal can be poured while the pouring machine 20 travels. In the system 1 for producing steel castings, since multiple melting furnaces 10 and the line 60 for conveying the molds are arranged across the pouring machine 20, the molten metal can be poured into one of the molds 70 during the shortest movement, namely, during the shortest period of time after the ladle 30 receives the molten metal.

Since the molten metal can be quickly poured into the molds 70 from the melting furnaces 10, the temperature drop of the molten metal for cast steel is low and the reduction in the fluidity is little, so that the molten metal can be poured into small molds 70. Further, since multiple melting furnaces 10 hold the molten metal for cast steel, the ladle 30 can at any time receive the molten metal from the melting furnaces 10. The pouring machine 20, of which the ladle 30 receives the molten metal, tilts the ladle 30 to pour the molten metal into the molds 70 that line up at the opposite side of the melting furnaces 10. Further, the pouring machine 20 can travel along the line 60 for conveying the molds. Thus, the molten metal can be poured into many molds 70. Thus, the system 1 for producing steel castings is appropriate to produce many steel castings. Further, the temperature of the molten metal for cast steel is measured and the data is transmitted to the controller. If the temperature is below the predetermined one, an alarm is generated to prevent the molten metal for cast steel of which the temperature has dropped and of which the fluidity has decreased from being poured into a mold to produce a defective steel casting.

Figure 3:
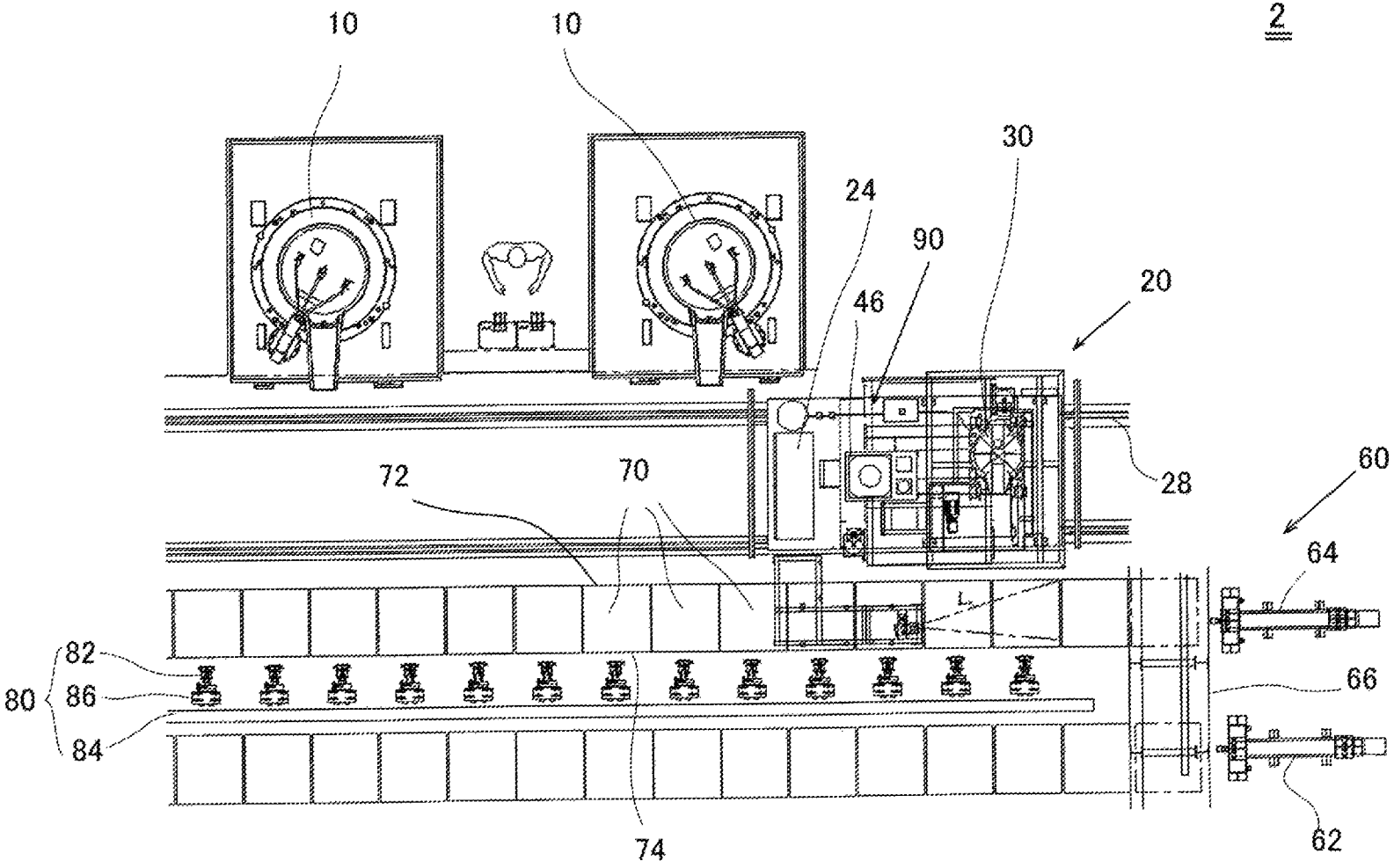
FIG. 3 is a plan view of the system for producing steel castings that differs from that in FIG. 1.

FIG. 3 is a plan view of the system 2 for producing steel castings that has a device 80 for decompression, to improve a run. It illustrates the furnaces 10, the pouring machine 20, and the line 60 for conveying the molds near the pouring machine 20 in the same way as FIG. 1 does. The system 2 for producing steel castings differs from the system 1 for producing steel castings only in that it has the device 80 for decompression. Thus duplicate discussions are omitted. Here, only the device 80 for decompression is discussed.

Figure 4:
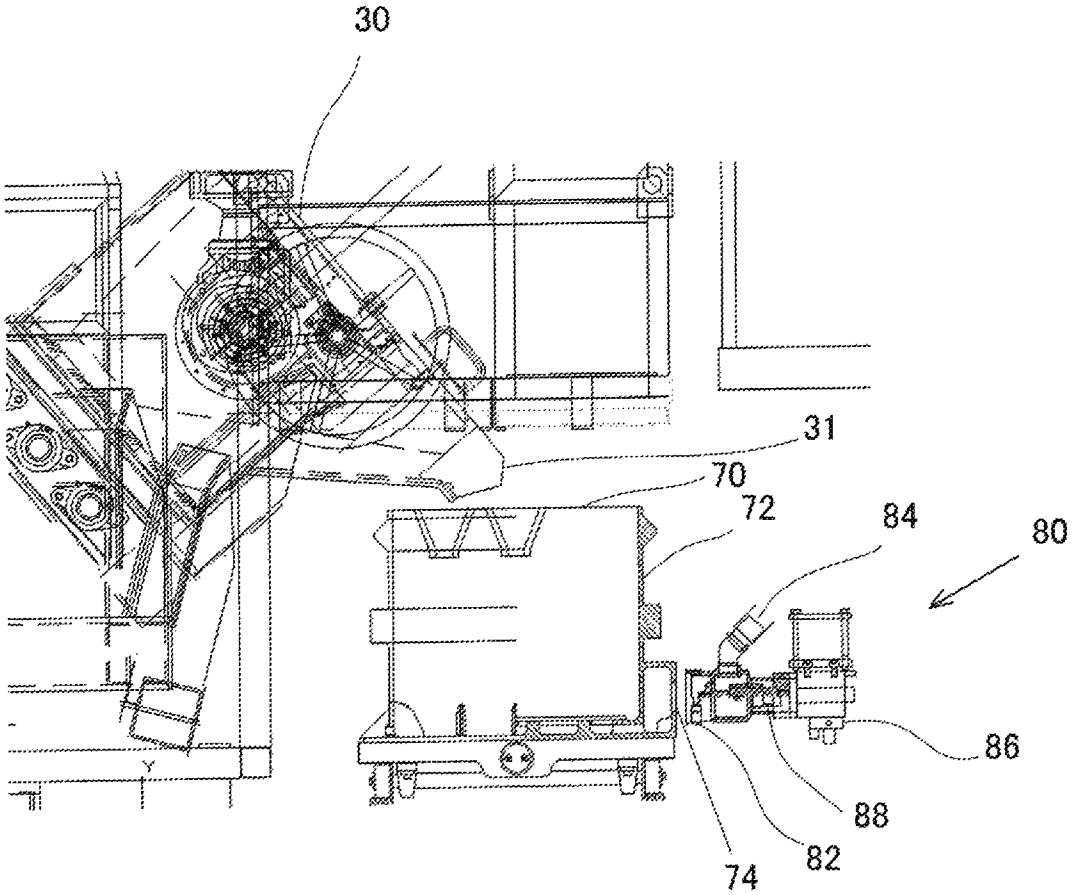
FIG. 4 is an enlarged side view to illustrate the mold and the device for decompression.

FIG. 4 illustrates the device 80 for decompression. The device 80 is enlarged. The device 80 for decompression is a device to decompress the mold 70. Here, the mold 70 is a tight flask mold that has a flask 72. A through-hole 74 is formed in the flask 72. The device 80 for decompression has multiple connecting ports 82 along the molds 70 on the line 60 for conveying the molds that are aligned next to the pouring machine 20. The connecting ports 82 are connected to the through-hole 74. The connecting ports 82 advance by means of a cylinder 88 for decompression and are connected to the through-hole 74 of the flask 72, to decompress the mold 70. The device 80 for decompression has a piping 84 for decompression that is connected to a decompressing source (not shown), such as a vacuum pump. It decompresses the mold 70 while the molten metal is poured into the mold 70. It does not decompress the mold 70 while it is pushed out by the line 60 for conveying the molds. It has a decompression valve 86, which is an on-off valve, to quickly change the connecting port 82 to be decompressed. When the decompression valve 86 is opened the cylinder 88 for decompression is elongated to press the connecting port 82 onto the through-hole 74. Thus, the mold 70 is suctioned by the piping 84 for decompression. Incidentally, the connecting ports 82 are equipped with a head for making a seal (not shown) that is biased by means of a spring to close. When the cylinder 88 for decompression is shortened, the connecting port 82 is closed. Since the configuration to decompress the molds 70 is publicly known, the detailed discussion is omitted.

Since the mold 70 is decompressed, the molten metal for cast steel that has been poured from the ladle 30 into the sprue (not shown) of the mold 70 is quickly and definitely poured into the mold 70. Namely, a better run can be achieved. Especially, the system 2 for producing steel castings has the multiple connecting ports 82 to quickly be connected to the mold 70 to be decompressed and to be decompressed by using the decompression valve 86, so that the mold 70 to be poured is decompressed. Thus, the mold 70 can be decompressed to enable a quick pouring of the molten metal from the pouring machine 20. By decompressing the mold 70 while the molten metal is being poured into it, a misrun can be prevented. Further, by decompressing the mold 70, any possible blow hole can be prevented.

Figure 5:
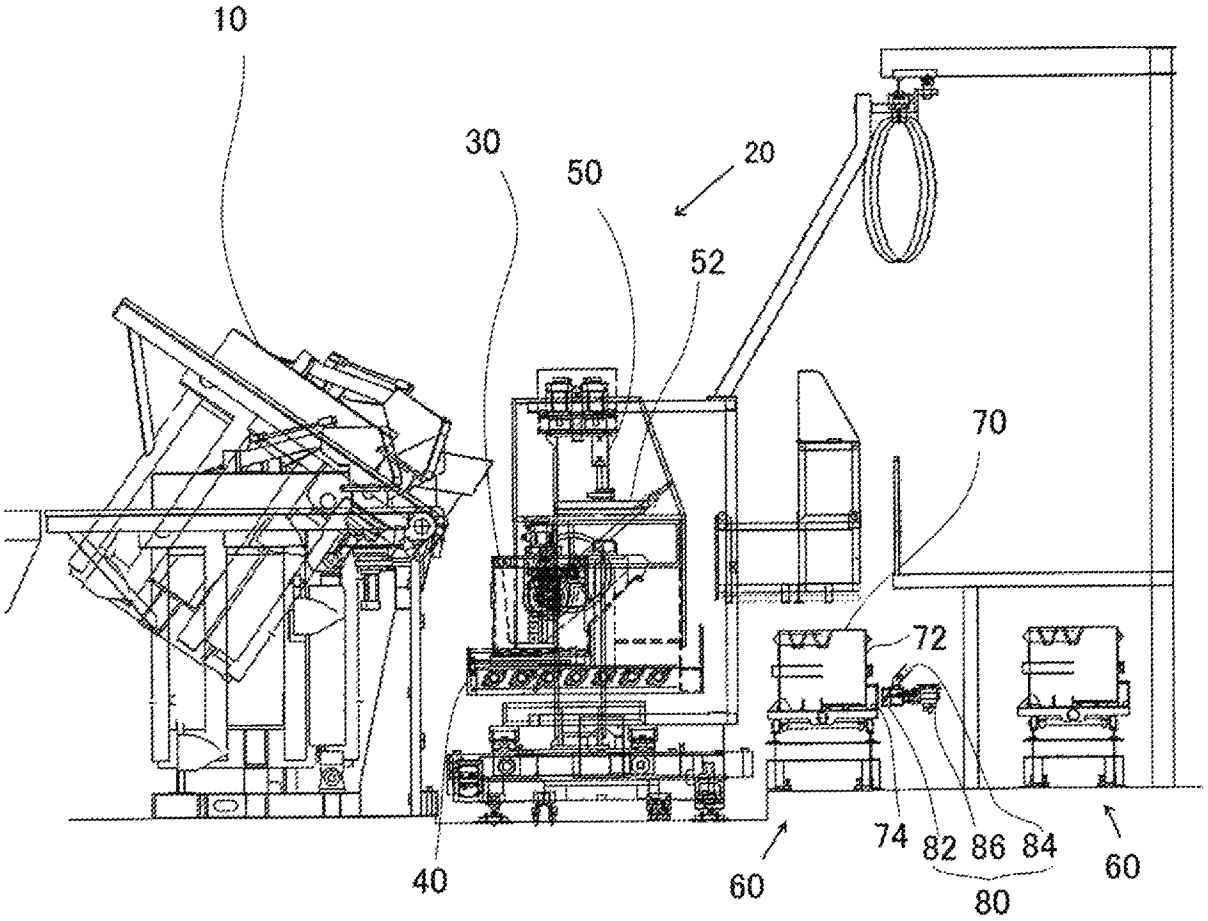
FIG. 5 is a side view of the furnace, the pouring machine, and the line for conveying the molds when the ladle receives molten metal from the furnace.
Figure 6:
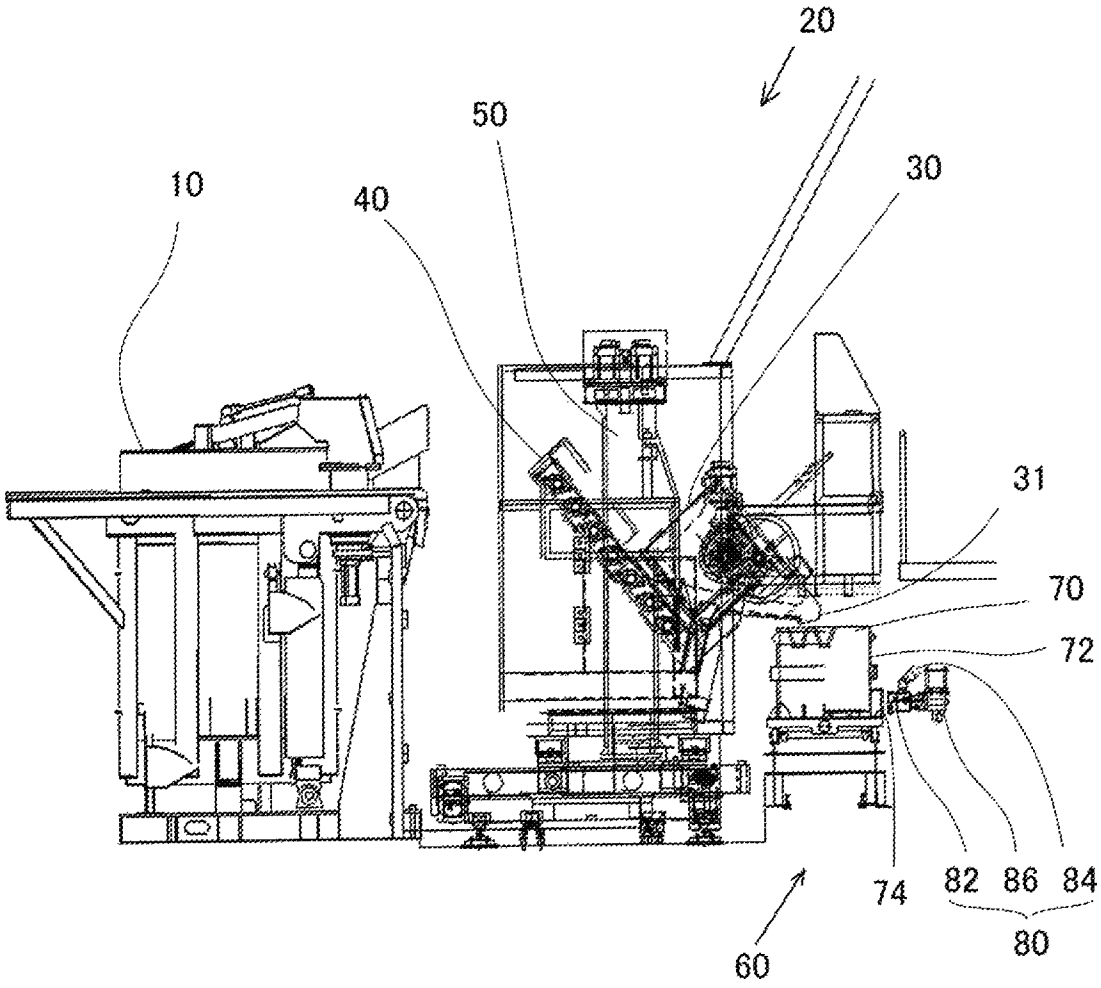
FIG. 6 is a side view of the furnace, the pouring machine, and the line for conveying the molds when the molten metal is poured from the ladle into a mold.
Figure 7:
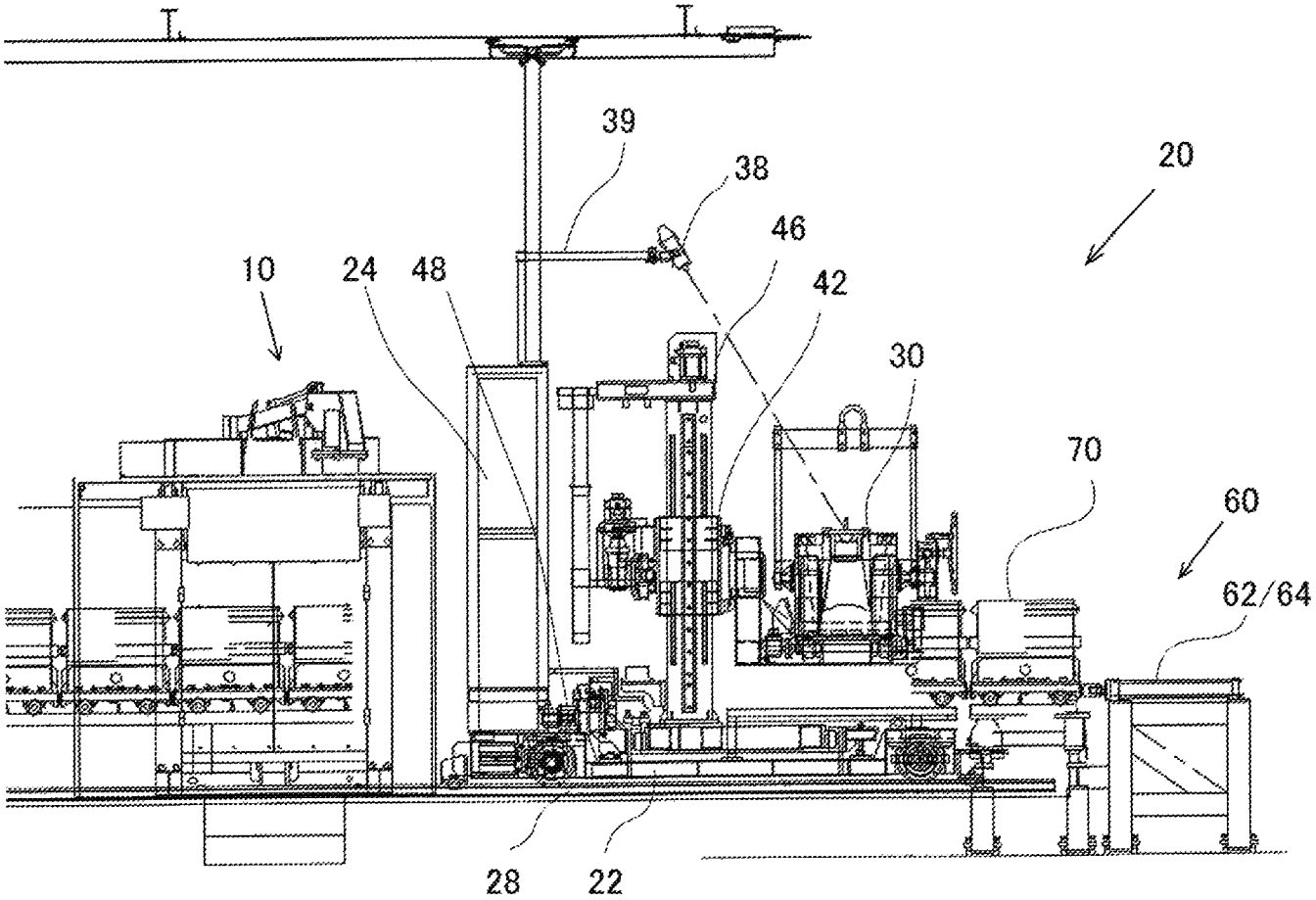
FIG. 7 is an enlarged front view of the pouring machine.

Next, with reference to FIGS. 5, 6, and 7, the pouring machine 20 of the system 1, 2 for producing steel castings is discussed in detail. Incidentally, FIGS. 5 and 6 illustrate the pouring machine 20 of the system 2 for producing steel castings, which has the device 80 for decompression. However, the pouring machine 20 is the same as the system 1 for producing steel castings as discussed above. In the pouring machine 20 the ladle 30 is placed on the roller conveyor 40, which is the device for moving the ladle. The roller conveyor 40 moves the ladle 30 between the position for receiving the molten metal from the melting furnaces 10 (see FIG. 5) and the position for pouring molten metal into the mold 70 (see FIG. 6). Incidentally, any known means to move the ladle 30 between the side near the melting furnaces 10 and the side near the molds 70, such as a rail and a bogie, can be used instead of the roller conveyor 40. Since the ladle 30 is moved by the roller conveyor 40 to the side near the melting furnaces 10 when receiving the molten metal from the melting furnaces 10 and the ladle 30 is moved by the roller conveyor 40 to the side near the molds 70 when pouring the molten metal into the mold 70, the ladle 30 can be quickly moved.

In the pouring machine 20 the device 42 for tilting the roller conveyor tilts the roller conveyor 40 (see FIG. 7). The device 42 for tilting the roller conveyor is similar to a known device for tilting a ladle, but it is different in that it tilts the roller conveyor 40. In the system 1, 2 for producing steel castings it is easy to tilt the roller conveyor 40, since the ladle 30 is small and light, as discussed below. The device 42 for tilting the roller conveyor, the device 46 for vertically moving the roller conveyor, and the device 48 for moving the roller conveyor back and forth, simultaneously control the three motions of the ladle 30, i.e., tilting, vertical motions, and movements back and forth, to tilt the ladle 30 around a tapping hole 31 to pour the molten metal. The pouring machine 20 has a device 50 for putting on a cover that removes a cover 52 from the ladle 30 when receiving the molten metal and that puts the cover 52 back on the ladle 30 after receiving the molten metal. For example, the device 50 for putting on a cover may be a cylinder that has a claw for engaging with a hanging bracket 54 of the cover 52, which is discussed below, and that is hung above the ladle 30. By elongating the cylinder and by moving the ladle 30 just below the device 50 for putting on a cover by means of the roller conveyor 40 while the claw is lowered, the claw engages with the hanging bracket 54 of the cover 52. Then, by shrinking the cylinder, the cover 52 is lifted and removed from the ladle 30. By elongating the cylinder, the cover 52 is placed on the ladle 30. Then the ladle 30 is moved away from below the device 50 for putting on a cover by means of the roller conveyor 40 so that the cover 52 remains on the ladle 30. Incidentally, the cover 52 may be placed on, and removed from, the ladle 30 by any other known means. Since the cover 52 is put on the ladle 30, the molten metal for cast steel in the ladle 30 is prevented from having its temperature decreased.

In the pouring machine 20, the device 42 for tilting the roller conveyor, the device 46 for vertically moving the roller conveyor, and the device 48 for moving the roller conveyor back and forth, simultaneously control the three motions of the ladle 30, i.e., tilting, vertical motions, and movements back and forth, to tilt the ladle 30 around a tapping hole 31 to pour the molten metal. Thus, a position for tapping is kept constant regardless of the amount of the molten metal for cast steel in the ladle 30, i.e., the angle that the ladle 30 is tilted. Since the position for tapping the molten metal for cast steel from the ladle 30 is kept constant, the position to pour the molten metal from the ladle 30 to the mold 70 is also kept constant, so that the condition to pour is properly controlled and a predetermined amount of the molten metal is definitely poured into the mold. Since both the roller conveyor 40 and the device 42 for tilting the roller conveyor are vertically moved and moved toward and away from the mold 70, no time is spent for transferring the ladle 30 from the roller conveyor 40 to the device 42 for tilting the roller conveyor. So, the molten metal can be poured into the ladle in such a shortened period of time after receiving the molten metal.

Figure 8:
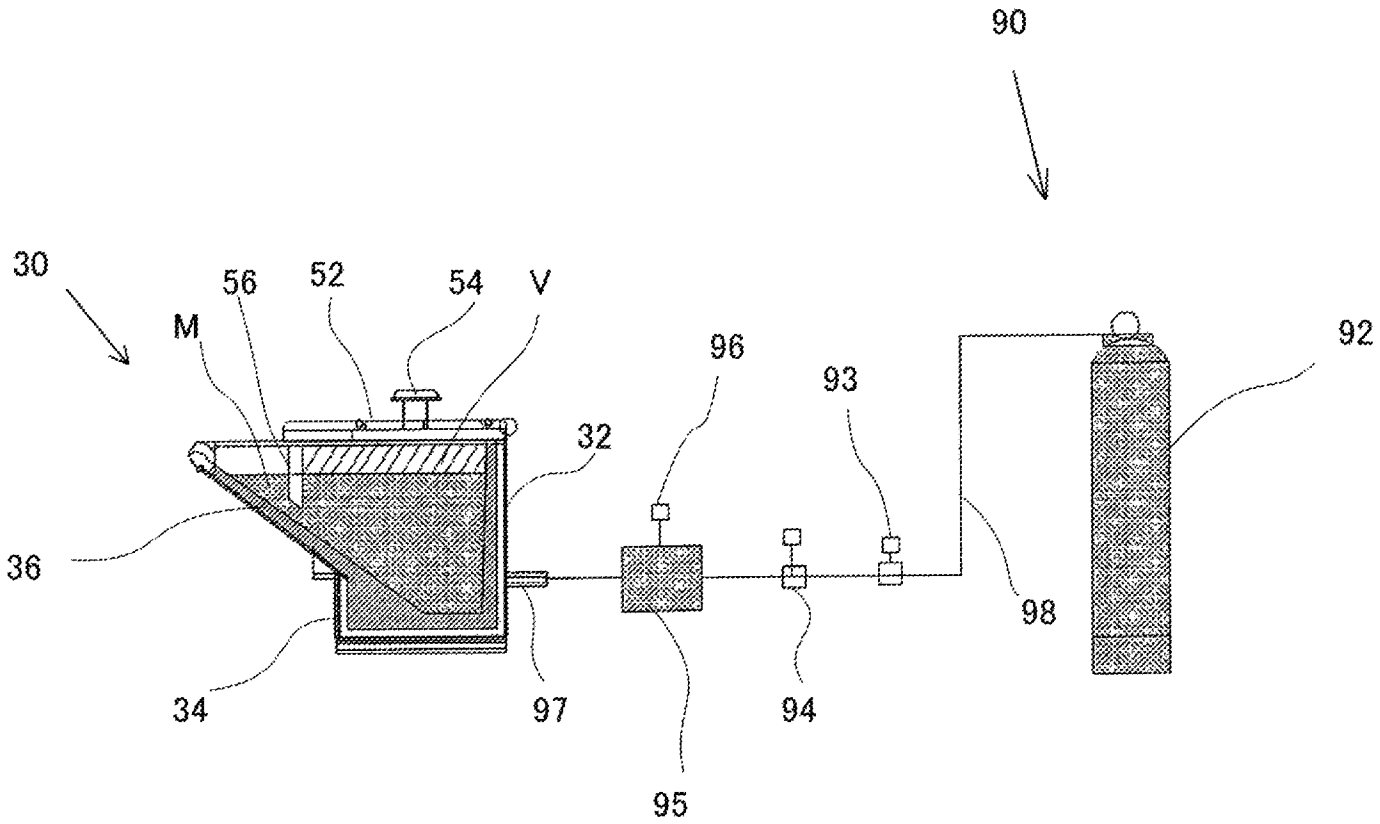
FIG. 8 is a schematic drawing of the ladle and the device for supplying antioxidant gas.

Next, with reference to FIG. 8, the ladle 30 is now discussed in detail. In the ladle 30 a refractory material 36 is affixed to the inside of a steel shell 32, which is an outer container. The refractory material 36 is made of a known material, such as a fire brick, Holo sand, or a ramming material, which is the same material as that of a conventional ladle for cast iron. In the ladle 30, a porous refractory layer 34 is formed between the steel shell 32 and the refractory material 36. The porous refractory layer 34 is formed by wet felt, but its material is not so limited. A through-hole is formed in the side wall of the ladle 30 and is connected to a port 97 for supplying antioxidant gas from a device 90 for supplying antioxidant gas. The porous refractory layer 34 allows the antioxidant gas to pass through it to fill the ladle 30 from the port 97 for supplying antioxidant gas. Namely, a portion V for encapsulating the antioxidant gas is filled with it. The antioxidant gas may be any inert gas, such as nitrogen, or may be any other gas that prevents the hot molten metal M for cast steel from being oxidized. Since the antioxidant gas fills the ladle 30, the hot molten metal M for cast steel is prevented from being oxidized.

The device 90 for supplying antioxidant gas supplies it to the ladle 30. The device 90 for supplying antioxidant gas has a tank 92 for the antioxidant gas, the port 97 for supplying antioxidant gas, and a piping 98 for the antioxidant gas that connects the tank 92 for the antioxidant gas with the port 97 for supplying antioxidant gas. On the piping 98 for the antioxidant gas a solenoid valve 93, a flow control valve 94, a tank 95 for cushioning, and a pressure sensor 96, are provided. The solenoid valve 93 cuts the connection between the tank 92 for the antioxidant gas and the ladle 30 when the device 90 for supplying antioxidant gas is stopped or when any abnormal operation occurs. The flow control valve 94 adjusts the flow of the antioxidant gas to be supplied based on the pressure that is measured by the pressure sensor 96. The tank 95 for cushioning suppresses sudden changes in the pressure of the antioxidant gas, i.e., the pressure in the ladle 30. The pressure sensor 96 measures the pressure of the encapsulated antioxidant gas. Since the pressure of the encapsulated antioxidant gas is measured, the flow to supply the antioxidant gas is adjusted. Further, an accident can be detected when the refractory material 36 is damaged, to allow the antioxidant gas to blow in the molten metal M for cast steel or when the cover 52 does not encapsulate the portion V for encapsulating the antioxidant gas. The device 90 for supplying antioxidant gas is typically placed on the pouring machine 20 (see FIGS. 1 and 3), but may be placed at another position.

The cover 52 is put on the ladle 30. The cover 52 is equipped with the hanging bracket 54 that is used for putting it on or removing it by means of the device 50 for putting on the cover (see FIGS. 5 and 6). It has a partition 56 that defines the portion V for encapsulating the antioxidant gas in the ladle 30, namely, that blocks a passage to the tapping portion of the ladle 30. The partition 56 extends from the cover 52 into the molten metal M in the ladle 30 so that the portion V for encapsulating the antioxidant gas is surrounded by the ladle 30, the cover 52, the partition 56, and the molten metal M for cast steel.

Next, the operations of the system 1, 2 for producing steel castings is discussed. Incidentally, the operations discussed below may be simultaneously done, if possible. The pouring machine 20 travels to the front of the melting furnace 10, in which the molten metal for cast steel is sufficiently hot, among multiple melting furnaces 10 that are aligned. The pouring machine 20 travels to the front of the melting furnace 10, where the molten metal is ready, so as to efficiently receive the molten metal. The pouring machine 20 moves the ladle 30 to the position for receiving the molten metal (see FIG. 5) by means of the roller conveyor 40 and removes the cover 52 from the ladle 30 by means of the device 50 for putting on a cover. The device 46 for vertically moving the roller conveyor and the device 48 for moving the roller conveyor back and forth may move the ladle 30 to a position where the molten metal is easily received or to a position where the molten metal is poured in line with the tilting of the melting furnace 10. The melting furnace 10 is tilted to pour the predetermined amount of the molten metal for cast steel into the ladle 30. Incidentally, the ladle 30 is preferably small, to hold about 200 to 500 kg of the molten metal. This is because the molten metal for cast steel that is received by the small ladle 30 is to be poured into the molds 70 within a short period of time, i.e., before the temperature can decrease.

When the ladle 30 receives the molten metal for cast steel, the cover 52 is put on the ladle 30 by means of the device 50 for putting on a cover. After the cover 52 is put on the ladle 30, the device 90 for supplying antioxidant gas may fill the ladle 30 with the antioxidant gas. The antioxidant gas prevents the molten metal for cast steel in the ladle 30 from being oxidized. Since the porous refractory layer 34 is formed in the ladle 30, the antioxidant gas easily fills the ladle 30. Incidentally, no antioxidant gas is filled based on the kind or temperature of the molten metal for cast steel, the time for pouring the received molten metal for cast steel into a mold, and so on. Then the temperature of the molten metal for cast steel is periodically measured by the temperature sensor 38 to be transmitted to the controller (not shown). The ladle 30 is moved to the position for pouring molten metal (see FIG. 6) by means of the roller conveyor 40. The pouring machine 20 travels to the front of the mold 70 into which the molten metal is poured.

The ladle 30 is tilted by means of the device 42 for tilting the roller conveyor to pour the molten metal into the mold 70. The device 42 for tilting the roller conveyor, the device 46 for vertically moving the roller conveyor, and the device 48 for moving the roller conveyor back and forth, simultaneously control the three motions of the ladle 30, i.e., tilting, vertical motions, and movements back and forth, to tilt the ladle 30 around a tapping hole 31 to keep the position for tapping the molten metal constant. When pouring the molten metal into one mold 70 is completed, the molds 70 on the line 60 for conveying the molds are conveyed by a distance that equals the length of a mold. The pouring machine 20 pours the molten metal into the next mold 70. When conveying the molds 70 on the line 60 for conveying the molds by said distance takes a long time, the pouring machine 20 may travel to the next mold 70 to pour the molten metal into it. Alternatively, it may pour the molten metal into the mold while it travels in line with the movement of the mold 70.

Suppose an example wherein the ladle 30 has a capacity of 500 kg, and 50 kg of the molten metal for cast steel is to be poured into the mold 70. The mold 70 for the cast steel is a shell mold that has a strength to enhance heat-resistance. That shell mold is made by adhering shells to each other that have been sintered with a resin. The shell mold is housed in the flask 72. A sand mold is filled for back-up in it. Then a weight is placed on them to prevent them from being lifted up. Setting one flask in the above way takes about 30 to 40 seconds. In contrast, pouring the molten metal into the mold 70 takes just three to five seconds. So, while the molds 70 on the line 60 for conveying the molds are conveyed at one time, the molten metal is poured into two molds 70. That is, the pouring machine 20 travels by a distance that equals the length of the mold 70, to pour the molten metal into two molds 70. It may travel upstream to pour the molten metal into three or more molds 70. This operation, namely, where the pouring machine 20 travels upstream by a distance that equals the length of the mold 70 and pours the molten metal into two molds 70, is repeated five times. Thus the pouring machine 20 travels upstream by a distance that equals the length of five molds. Then the pouring machine 20 travels to the front of the melting furnaces 10 to receive the molten metal by the ladle 30. Then it returns to the position to start pouring the molten metal into the molds 70. In this way, the pouring machine 20 spends no time for waiting. Further, the pouring machine 20 uses, for receiving the molten metal from the melting furnaces 10, the period of time when the molds on the line 60 for conveying the molds are conveyed by a length that equals the distance of the length by which the pouring machine 20 travels upstream. Thus, the molten metal for cast steel can be prevented from having its temperature decreased. Further, an efficient operation can be achieved.

In the system 1, 2 for producing steel castings, a ladle that has received the molten metal from the melting furnaces 10 is not transported by a bogie for transporting the ladle, nor is it transferred to a pouring machine. The molten metal is directly received by the ladle 30 of the pouring machine 20. When the ladle 30 receives the molten metal, the cover 52 is put on the ladle 30. The ladle 30 is moved from the position for receiving the molten metal to the position for pouring molten metal by means of the roller conveyor 40. The device 42 for tilting the roller conveyor, the device 46 for vertically moving the roller conveyor, and the device 48 for moving the roller conveyor back and forth, simultaneously control the three motions of the ladle 30, i.e., tilting, vertical motions, and movements back and forth, to tilt the ladle 30 around a tapping hole 31 to pour the molten metal into the mold 70. After pouring the molten metal into the mold 70, the pouring machine 20 travels to the position to pour the molten metal into the next mold 70. In this way, the time from receiving the molten metal to pouring it into them is significantly shortened, to prevent the temperature of it from decreasing. So when the molten metal is at a very high temperature and the fluidity of it would tend to be reduced if the temperature were to decrease, it can still be poured into the mold before the temperature decreases. Thus, it can be properly poured into a small and complicated mold.

The temperature of the molten metal for cast steel in the ladle 30 is measured by the temperature sensor 38 to transmit the measured data to the controller. The controller (that includes another device, such as the control board of the pouring machine 20) generates an alarm when the temperature is below the predetermined one. The alarm may be a light or sound that is seen or heard by an operator or a signal that is transmitted to the controller, etc. The operator may control the operations of the system 1, 2 for producing steel castings based on the alarm. Alternatively, when the alarm is generated, the controller may cause the pouring machine 20 to stop pouring into the mold 70 and cause the molten metal in the ladle 30 to be returned to the melting furnaces 10. That is, a defective steel casting is prevented from being produced, since no molten metal for cast steel of which the temperature has been decreased is poured into a mold, to cause improper pouring. Since the molten metal is returned to the melting furnaces, no molten metal is wasted.

In the system 2 for producing steel castings the mold 70 to be poured is decompressed. Since the mold 70 is decompressed, a better run can be achieved and any possible blow hole is prevented. In doing so, multiple connecting ports 82 are provided and the connecting port 82 to be connected to the mold 70 that is to be poured or has been poured is efficiently changed, to be decompressed.

The mold 70 into which the molten metal for cast steel has been poured moves on the line 60 for conveying the molds so that the molten metal for cast steel in it is cooled, to thereby solidify. Thus, it becomes the steel casting. Then the steel casting is taken out of the mold at a shake-out machine (not shown) to be sent to the following process. The mold is shaken out, to thereby become sand. The sand is sent to a system for conditioning foundry sand, etc. (not shown) and is again used for molding.

In the above discussion the molten metal is poured from the melting furnaces 10 to the ladle 30. However, it may be poured from a holding furnace.

In the above discussion the shell mold 70 with a back-up is used. However, the present invention is not limited to it. A shell mold without a back-up may be used, especially when the strength of the shell is high. And another type of mold can be used.

Below, the main reference numerals and symbols that are used in the detailed description and drawings are listed.

1, 2 the system for producing steel castings
10 the furnace (the melting furnace)
20 the pouring machine
22 the travelling bogie
24 the control board
28 the rail
30 the ladle
31 the tapping hole
32 the steel shell
34 the porous refractory layer
36 the (conventional) refractory material
38 the temperature sensor
39 the arm for the temperature sensor
40 the roller conveyor (the device for moving the ladle)
42 the device for tilting the roller conveyor
46 the device for vertically moving the roller conveyor
48 the device for moving the roller conveyor back and forth
50 the device for putting on a cover
52 the cover
54 the hanging bracket (of the cover)
56 the partition
60 the line for conveying the molds
62 the pusher
64 the cushion
66 the traversers
70 the mold
72 the flask
74 the through-hole
80 the device for decompression
82 the connecting ports
84 the piping for decompression
86 the valve for decompression (the on-off valve)
88 the cylinder for the device for decompression
90 the device for supplying antioxidant gas
92 the tank for the antioxidant gas
93 the solenoid valve
94 the flow control valve
95 the tank for cushioning
96 the pressure sensor
97 the port for supplying antioxidant gas
98 the piping for the antioxidant gas
M the molten metal
V the portion for encapsulating the antioxidant gas

The invention claimed is:

1. A system for producing steel castings comprising:
multiple furnaces that are aligned and hold molten metal for cast steel;
a pouring machine that has a ladle that receives the molten metal from the furnaces, wherein the pouring machine travels in parallel to a line of the multiple furnaces and pours the molten metal into a mold by tilting the ladle;
a line for conveying molds that intermittently conveys multiple molds that are aligned in parallel to a direction in which the pouring machine travels, wherein the line for conveying the molds is located on an opposite side of the furnaces and across the pouring machine: and
a temperature sensor that measures a temperature of the molten metal in the ladle so as to generate an alarm if the measured temperature is below a predetermined temperature.

2. The system for producing steel castings of claim 1, wherein, when the alarm is generated, pouring molten metal is stopped and the molten metal is returned to the furnaces.

3. The system for producing steel castings of claim 1, wherein the pouring machine has a device for moving the ladle that moves the ladle between a side of the furnaces and a side of the molds.

4. The system for producing steel castings of claim 3, wherein the device for moving the ladle is a roller conveyor that moves the ladle from a position for receiving the molten metal from the furnaces to a position for pouring molten metal into the molds.

5. The system for producing steel castings of claim 4, wherein the pouring machine has a travelling bogie that transports the pouring machine, a device for vertically moving the roller conveyor, a device for moving the roller conveyor back and forth that moves the roller conveyor toward the position for receiving the molten metal and the position for pouring molten metal, and a device for tilting the roller conveyor that tilts the roller conveyor to cause the ladle to pour the molten metal into the molds.

6. The system for producing steel castings of claim 5, wherein the pouring machine has a device for putting on a cover that puts the cover on the ladle and removes the cover from the ladle.

7. The system for producing steel castings of claim 6, wherein each mold is a tight flask mold that has a flask and a through-hole is formed in the flask, the system further comprising a device for decompression that has multiple connecting ports along the line for conveying the molds, wherein the ports are connected to the through-hole of the flask of each mold, into which the molten metal is poured, so as to decompress each mold.

8. The system for producing steel castings of claim 7 further comprising:

a device for supplying antioxidant gas that fills the ladle with antioxidant gas.

9. The system for producing steel castings of claim 8, wherein the ladle has a porous refractory layer between a metal shell and a refractory material.

10. The system for producing steel castings of claim 1, wherein the pouring machine has a device for putting on a cover that puts the cover on the ladle and removes the cover from the ladle.

11. The system for producing steel castings of claim 1, wherein each mold is a tight flask mold that has a flask and a through-hole is formed in the flask, the system further comprising a device for decompression that has multiple connecting ports along the line for conveying the molds, wherein the ports are connected to the through-hole of the flask of each mold, into which the molten metal is poured, so as to decompress each mold.

12. The system for producing steel castings of claim 1 further comprising:

a device for supplying antioxidant gas that fills the ladle with antioxidant gas.

13. The system for producing steel castings of claim 12, wherein the ladle has a porous refractory layer between a metal shell and a refractory material.

* * * * *